US008821097B2

(12) United States Patent
Page et al.

(10) Patent No.: US 8,821,097 B2
(45) Date of Patent: Sep. 2, 2014

(54) LAUNDRY SHUTTLE SYSTEM

(75) Inventors: Michael C. Page, North Syracuse, NY (US); Stephen D. Wilbur, East Freetown, NY (US); Joseph B. Gudenburr, IV, Manlius, NY (US); R. Scott Morse, Cortland, NY (US)

(73) Assignee: G.A. Braun, Inc., Syracuse, NY (US)

( * ) Notice: Subject to any disclaimer, the term of this patent is extended or adjusted under 35 U.S.C. 154(b) by 296 days.

(21) Appl. No.: 12/892,347

(22) Filed: Sep. 28, 2010

(65) Prior Publication Data

US 2011/0076115 A1 Mar. 31, 2011

Related U.S. Application Data

(60) Provisional application No. 61/246,301, filed on Sep. 28, 2009.

(51) Int. Cl.
*D06F 95/00* (2006.01)

(52) U.S. Cl.
CPC ..... *D06F 95/00* (2013.01)
USPC ..... 414/13; 414/349; 198/311; 198/313

(58) Field of Classification Search
USPC ..... 414/13, 349–353, 376, 508; 198/300, 198/309, 509; 68/210, 235 R
See application file for complete search history.

(56) References Cited

U.S. PATENT DOCUMENTS 1,645,998 A * 10/1927 Perry et al. ..... 414/13
3,712,090 A 1/1973 Toth et al.
3,742,738 A 7/1973 Frotriede
3,783,466 A * 1/1974 Bernardi ..... 15/53.2
3,998,341 A * 12/1976 Wolf ..... 414/565
4,195,498 A 4/1980 Pellerin
4,402,392 A * 9/1983 Fabian et al. ..... 198/311
4,461,959 A 7/1984 Pellerin
4,835,993 A 6/1989 Dreher
5,256,021 A * 10/1993 Wolf et al. ..... 414/393
5,357,772 A 10/1994 Hendren
5,992,186 A * 11/1999 Fesmire et al. ..... 68/210
6,116,849 A 9/2000 Fesmire et al.
6,193,086 B1 * 2/2001 Gunnlaugsson et al. ..... 212/290
7,223,059 B2 * 5/2007 Smith et al. ..... 414/505
7,641,040 B2 * 1/2010 Harris ..... 198/396

(Continued)

FOREIGN PATENT DOCUMENTS

EP 0287989 A2 4/1988

OTHER PUBLICATIONS

GA Braun, Laundry Equipment and Smart Systems Solutions product brochure, Mar. 2009.*

*Primary Examiner* — Gregory Adams
*Assistant Examiner* — Lynn Schwenning
(74) *Attorney, Agent, or Firm* — George R. McGuire; Bond Schoeneck & King

(57) ABSTRACT

A conveyor shuttle having a conveyor belt for conveying textiles across a wash alley from a washing machine (selected from among a plurality of washing machines) to a drying machine (selected from among a plurality of drying machines). The shuttle travels along the work alley among and between the washing machines and the drying machines. Some embodiments further include guide hardware to help guide soiled laundry into the washing machine. Some embodiments include an operator platform and an operator control system so that a human user can ride on the shuttle and help control various wash alley functions.

8 Claims, 6 Drawing Sheets

(56) References Cited

U.S. PATENT DOCUMENTS

| | | | | |
|---|---|---|---|---|
| 2004/0129031 | A1 | 7/2004 | Bringewatt et al. | |
| 2004/0191036 | A1 | 9/2004 | Nield | |
| 2007/0113599 | A1 | 5/2007 | Harfmann | |
| 2009/0116943 | A1 * | 5/2009 | Valere | 414/467 |

* cited by examiner

LAUNDRY SHUTTLE SYSTEM

RELATED APPLICATION

The present application claims priority to U.S. provisional patent application No. 61/246,301, filed on Sep. 28, 2009; all of the foregoing patent-related document(s) are hereby incorporated by reference herein in their respective entirety(ies).

BACKGROUND OF THE INVENTION

1. Field of the Invention

The present invention relates to shuttle systems for moving loose goods between machines that operate on the loose goods and more particularly to a laundry shuttle system for moving laundry into and/or out of industrial washing machines and industrial drying machines.

2. Description of the Related Art

One conventional industrial laundry washing/drying system includes a shuttle (that rides on rails) with a conveyor belt. The conveyor belt is oriented to convey in a direction transverse to the direction that the rails run. In operation, this conventional shuttle: (i) travels along the rails to the vicinity of an industrial washing machine that has completed washing a load of laundry; (ii) receives the wet laundry onto its conveyor belt from the industrial washing machine; (iii) travels along the rails to move the wet laundry to the vicinity of an industrial dryer; and (iv) conveys the wet laundry into the industrial dryer using the conveyor belt. The conveyor belt may telescope, for example, to avoid physical interference with the washer or dryer before it is fully aligned with the washer or dryer.

Typically, these shuttle systems, described in the preceding paragraph, only move laundry from an industrial washer to an industrial dryer. Typically, the operation of getting soiled laundry into the industrial washing machine is not performed by the shuttle, but rather either: (i) by hand; or (ii) by separate automatic hardware.

First, regarding the systems where laundry is fed by hand, when soiled laundry is fed into the industrial washing machine by these by-hand systems, a user empties articles of soiled laundry from a bag and into the mouth of a spinning washing machine. There is some level of risk of injury to the user due to the heavy moving machinery of the industrial washing machine.

Second, regarding systems where soiled laundry is automatically fed into the industrial washing machine, a bag of soiled laundry is suspended from a track on the ceiling. The bag is moved along the track to a position above the washing machine, in the vicinity of the mouth of the washing machine. Bag-opening hardware and laundry-guiding hardware that is built into each industrial washing machine open the bag (by opening a special fastener at the bottom of the bag) and guide the soiled articles of laundry down into the mouth of the washing machine. Generally speaking, there are two types of guiding hardware: (i) passive; and (ii) active. Passive guiding hardware typically takes the form of a chute or a ramp that the soiled articles of laundry fall down onto from above and then slide along down into the mouth of the washing machine. Active guiding hardware takes the form of a pusher that moves to push and/or pull the soiled articles of laundry down into the mouth of the washing machine.

Some publications that may be of interest may include the following: (i) U.S. Pat. No. 5,992,186 ("Fesmire 1"); (ii) U.S. Pat. No. 3,742,738 ("Frotriede"); (iii) U.S. Pat. No. 4,835,993 ("Dreher"); (iv) U.S. Pat. No. 3,712,090 ("Toth"); (v) U.S. Pat. No. 4,461,959 ("Pellerin 1"); (vi) U.S. Pat. No. 4,195,498 ("Pellerin 2"); (vii) European Patent Application 0 287 989 A2 ("Washex"); (ix) US patent application ("USPA") 2007/0113599 ("Harfmann"); (x) USPA 2004/0129031 ("Bringewatt"); (xi) U.S. Pat. No. 5,357,772 ("Hendren"); (xii) German Offenlegungsschrift DE 10 2006 055 494 A1 ("Kannegiesser"); (xiii) USPA 2004/0191036 ("Nield"); and (xiv) U.S. Pat. No. 6,116,849 ("Fesmire 2").

Description of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

One aspect of the present invention is directed to a shuttle with a conveyor belt for moving articles (for example, soiled laundry) between industrial machines (for example, washers and dryers), where the shuttle is further equipped with guide hardware to guide the articles as they are lowered from above into an opening (herein called a mouth) of an industrial machine. Preferably, the guide hardware is in the form of a movable chute that can move (at least) back and forth along the direction of the conveyor belt. Building the guide hardware into the shuttle can reduce or eliminate: (i) the need to have guide hardware built into each of the machines that require such guides; and/or (ii) the need to have human users assist in guiding articles into the mouth. In at least some preferred embodiments, the guide hardware only operates at one end of the conveyor belt. For example, in many industrial washer and dryer "work alleys," guide hardware is only really needed as bags of laundry descended from the ceiling are fed into the industrial washer, but not needed for helping to convey articles that have been washed in the industrial washer into the industrial dryer. In these embodiments, the guide hardware may be moveable, but this guide hardware will generally remain on the washer-side of the shuttle and/or over the frame of the shuttle.

Another aspect of the present invention is directed to a shuttle with a conveyor belt for moving articles (for example, soiled laundry) between industrial machines (for example, washers and dryers), where the shuttle is further equipped with an operator platform and operator controls so that a human user may ride on the shuttle and help control its operation. For example, the user may help control the motion of the shuttle along the work alley. As a further example, the user on the shuttle may help control the operations of the washers, dryers and/or the conveying system that conveys bags of soiled laundry over the vicinity of washing machines that will wash that laundry. As still a further example, the human user may help control the operations of security gates that restrict people from going into the work alley and/or near the industrial machines. By putting (at least some control) of operations in the hands of a human user who is riding the shuttle, it can help ensure that the person who is controlling operations will not be injured by the shuttle and/or by the industrial machines. Preferably, the operator platform includes at least one protective wall (see DEFINITIONS section). Preferably, the operator controls includes at least one foot switch that is positioned to require the user to actually be fully in position on the operator platform when exercising control, in order to help protect that user from injury by the shuttle and/or by the industrial machines.

Various embodiments of the present invention may exhibit one or more of the following objects, features and/or advantages:

(i) improved industrial machine operator(s) safety;

(ii) more reliable operation of industrial washers and dryers;

(iii) more pleasant work environment for industrial machine operators;

(iv) cost savings of not building chute type hardware into each washing machine;

(v) worker does not need to get near the bag to guide the soiled laundry into the washing machine; and/or (vi) added security of allowing bags of soiled laundry to be unloaded remotely by an operator who is effectively forced to be standing on the shuttle increases safety and may allow other security sub-systems, such as gating or fencing to be reduced or minimized.

According to one aspect of the present invention, a conveyor shuttle is for use in a work alley defining a work alley direction having a plurality of first type industrial machines on a first side of the work alley and a plurality of second type industrial machines on a second side of the work ally. The shuttle includes: a shuttle driving system; a chassis; a conveyor belt system; and a guide hardware system. The shuttle drive system, the conveyor belt system and the guide hardware are mechanically connected (directly or indirectly) to the chassis. The shuttle drive system is structured, located and/or connected to drive the shuttle into motion so that it can travel along the work alley among and between the first type machines and the second type machines;

the conveyor belt system comprises a conveyor belt that is structured, connected and/or located to: (i) allow loading of articles from the first type machines; (ii) allow unloading of articles into the second type machines; and (iii) convey articles, in a conveyor belt direction that is generally transverse to the work alley direction, from the first side to the second side; and the guide hardware system is structured, connected and/or located to guide articles as they travel from location generally above each first side machine and into an opening in each first side machine.

According to a further aspect of the present invention, a conveyor shuttle is for use in a work alley defining a work alley direction having a plurality of first type industrial machines on a first side of the work alley and a plurality of second type industrial machines on a second side of the work ally. The shuttle including: a shuttle driving system; a chassis; a conveyor belt system; an operator platform system; and an operator control system. The shuttle drive system, the conveyor belt system, the operator control system and the operator platform system are mechanically connected (directly or indirectly) to the chassis. The shuttle drive system is structured, located and/or connected to drive the shuttle into motion so that it can travel along the work alley among and between the first type machines and the second type machines. The conveyor belt system comprises a conveyor belt that is structured, connected and/or located to: (i) allow loading of articles from the first type machines; (ii) allow unloading of articles into the second type machines; and (iii) convey articles, in a conveyor belt direction that is generally transverse to the work alley direction, from the first side to the second side. The operator platform system is sized, shaped, structured and located to accommodate a user riding on the shuttle. The operator control system is structured, located and or connected to allow the human user to at least partially control at least one of the following functions: travel of the shuttle along the work alley direction, operation of the first side machines, operation of the second side machines, operation of the conveyor belt system, operation of any security system protecting the work alley and/or movement of any guide hardware.

According to a further aspect of the present invention, a conveyor shuttle is for use in a wash alley defining a wash alley direction having a plurality of industrial washing machines on a washing side of the wash alley and a plurality of industrial drying machines on a drying side of the wash ally. The shuttle including: a shuttle driving system; a chassis; a conveyor belt system; a guide hardware system; an operator platform system; and an operator control system. The shuttle drive system, the conveyor belt system and the guide hardware are mechanically connected (directly or indirectly) to the chassis. The shuttle drive system is structured, located and/or connected to drive the shuttle into motion so that it can travel along the wash alley among and between the washing machines and the drying machines. The conveyor belt system includes a conveyor belt that is structured, connected and/or located to: (i) allow loading of damp textile articles from the washing machines; (ii) allow unloading of damp textile articles into the second type machines; and (iii) convey articles, in a conveyor belt direction that is generally transverse to the work alley direction, from the washing side to the drying side. The guide hardware system is structured, connected and/or located to guide articles as they travel from location generally above each first side machine and into an opening in each first side machine. The operator platform system is sized, shaped, structured and located to accommodate a user riding on the shuttle. The operator control system is structured, located and or connected to allow the human user to at least partially control at least one of the following functions: travel of the shuttle along the work alley direction, operation of the first side machines, operation of the second side machines, operation of the conveyor belt system, operation of any security system protecting the work alley and/or movement of any guide hardware.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
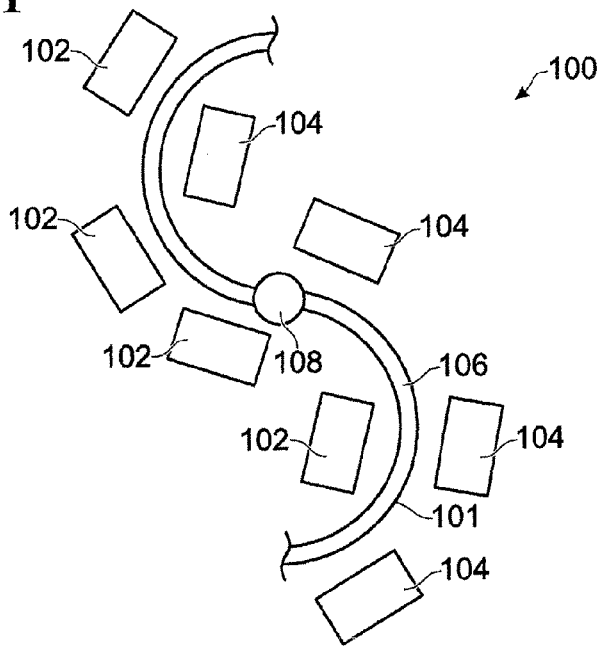
FIG. 1 is a schematic top view of a work alley according to the present invention.

FIG. 1 shows a work alley 100 in which a conveyor shuttle 108 according to the present invention is in use. Work alley 100 further includes: rails 101; industrial washing machines 102; and industrial dryers 104. In this embodiment the work alley direction is not in a straight line, but in many preferred embodiments it will be a straight line. The work alley could also be in the form of a loop.

In operation of the work alley, the conveyor shuttle travels in the work alley direction along the rails. In alternative embodiments, the work alley may not have rails, and the conveyor shuttle may fun on a flat floor on wheels or an endless track or the like. However, rails are preferable because they serve to control the position of the conveyor shuttle in the direction transverse to the work alley direction, and thereby help prevent the possibility that the conveyor shuttle will hit the industrial machines, or other workers.

In operation, when a load of soiled wash is to be washed, it is conveyed to the vicinity of an available washing machine 102 by a separate conveyance sub-system (not shown). Preferably, this conveyance system involves the suspension of a bag of soiled laundry from a track on the ceiling so that the bag can be moved along the track over any of the washing machines. However, other conveyance systems are possible. For example, human worker may bring the bags of soiled laundry to the washing machines by human power. Once the solied laundry is conveyed to the vicinity of an available washer, the guide hardware (not shown) is used to help guide the soiled laundry into the mouth of the available washing machine. In some embodiments of the present invention, the guide hardware may include a bag unfastening sub-system to unfasten a fastener that closes an opening in the bag so that the laundry pours out of the bag, and can be guided into the mouth of the washing machine by the rest of the guide hardware. The operation of the guide hardware will be discussed in more detail below.

While the soiled laundry is being washed, the shuttle is redeployed to other operations involving other washers and dryers. When the soiled laundry is finished being washed, the shuttle returns along the rails to the washing machine, and the washing machine dumps the clean, but damp, laundry onto the conveyor belt (not separately shown). The shuttle then moves along the work alley to an available dryer 104. The conveyor belt is used to convey the damp laundry across the work alley (that is in a direction generally transverse to the work alley) from the washer side to the dryer side and, thence, into the dryer. In preferred embodiments the guide hardware does not help guide the damp laundry from the washing machine onto the conveyor belt, or from the conveyor belt into the dryer, but some embodiments within the scope of the present invention may use guide hardware to help out with these portions of the conveyance of the laundry. In some embodiments of the present invention, the conveyor belt may move and/or telescope in the conveyor belt direction (that is, generally transverse to the work alley direction), in order to: (i) move into close engagement with a washer and/or dryer that the conveyor belt is receiving from and/or feeding into; but (ii) move out of the way of the industrial machines as the shuttle moves along the work alley between machines.

Figure 2:
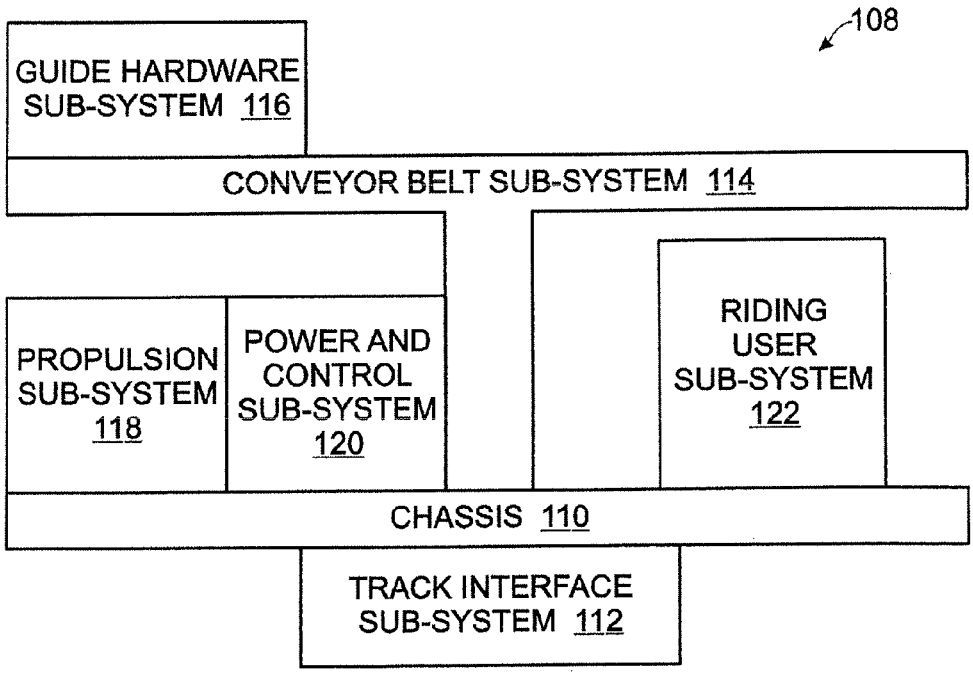
FIG. 2 is a schematic, side view of a first embodiment of a conveyor shuttle according to the present invention.

As shown in FIG. 2, an exemplary conveyor shuttle 108 according to the present invention includes: chassis 110; track interface sub-system 112; conveyor belt sub-system 114; guide hardware sub-system 116; propulsion sub-system 118; power and control sub-system 120; and riding user sub-system 122.

The track interface sub-system is preferable wheels designed to ride along two parallel tracks, but there may be embodiments of the present invention that do not ride on tracks as mentioned above. The wheels are driven by the propulsion sub-system, which is preferable an electric motor (not shown). The propulsion sub-system gets its energy from the power and control sub-system. The guide hardware sub-system is an important feature of at least some embodiments of the present invention, and will be discussed in more detail in connection with the next embodiment, below. The riding user sub-system is an important feature of at least some embodiments of the present invention, and will also be discussed in more detail in connection with the next embodiment, below.

Figure 9:
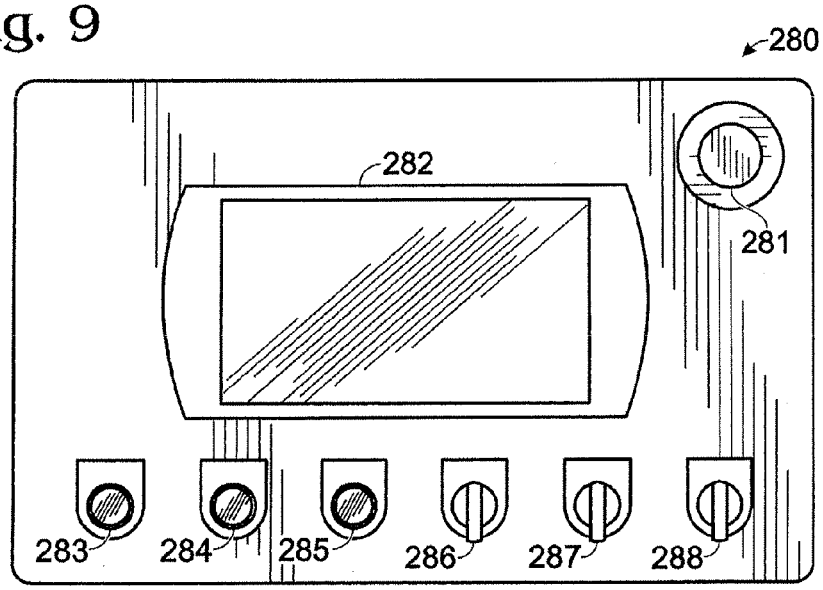
FIG. 9 is a top view of the operator controls of the second embodiment shuttle.
Figure 7:
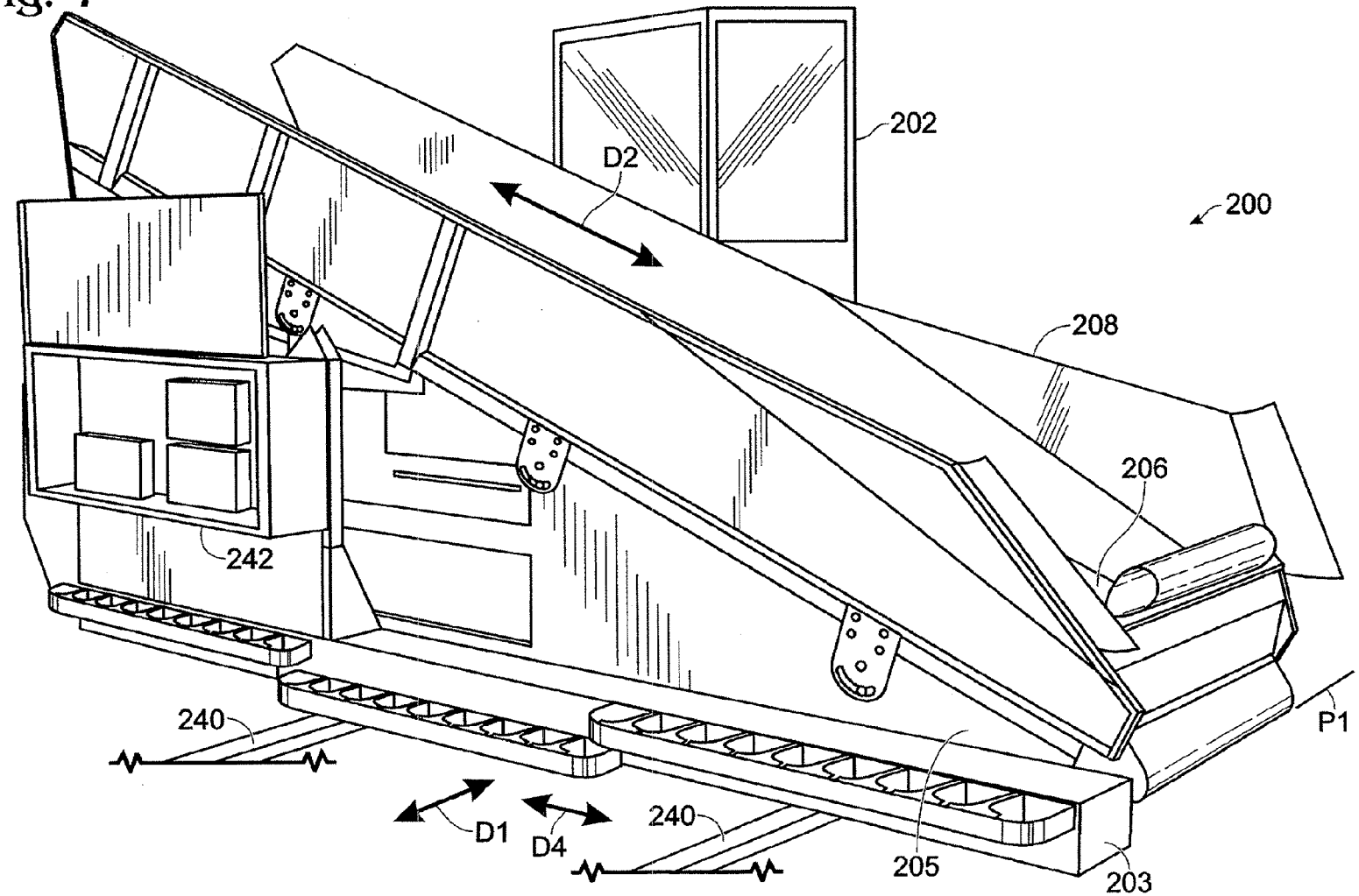
FIG. 7 is a perspective (generally side) view of the second embodiment shuttle without the guide hardware in place
Figure 8:
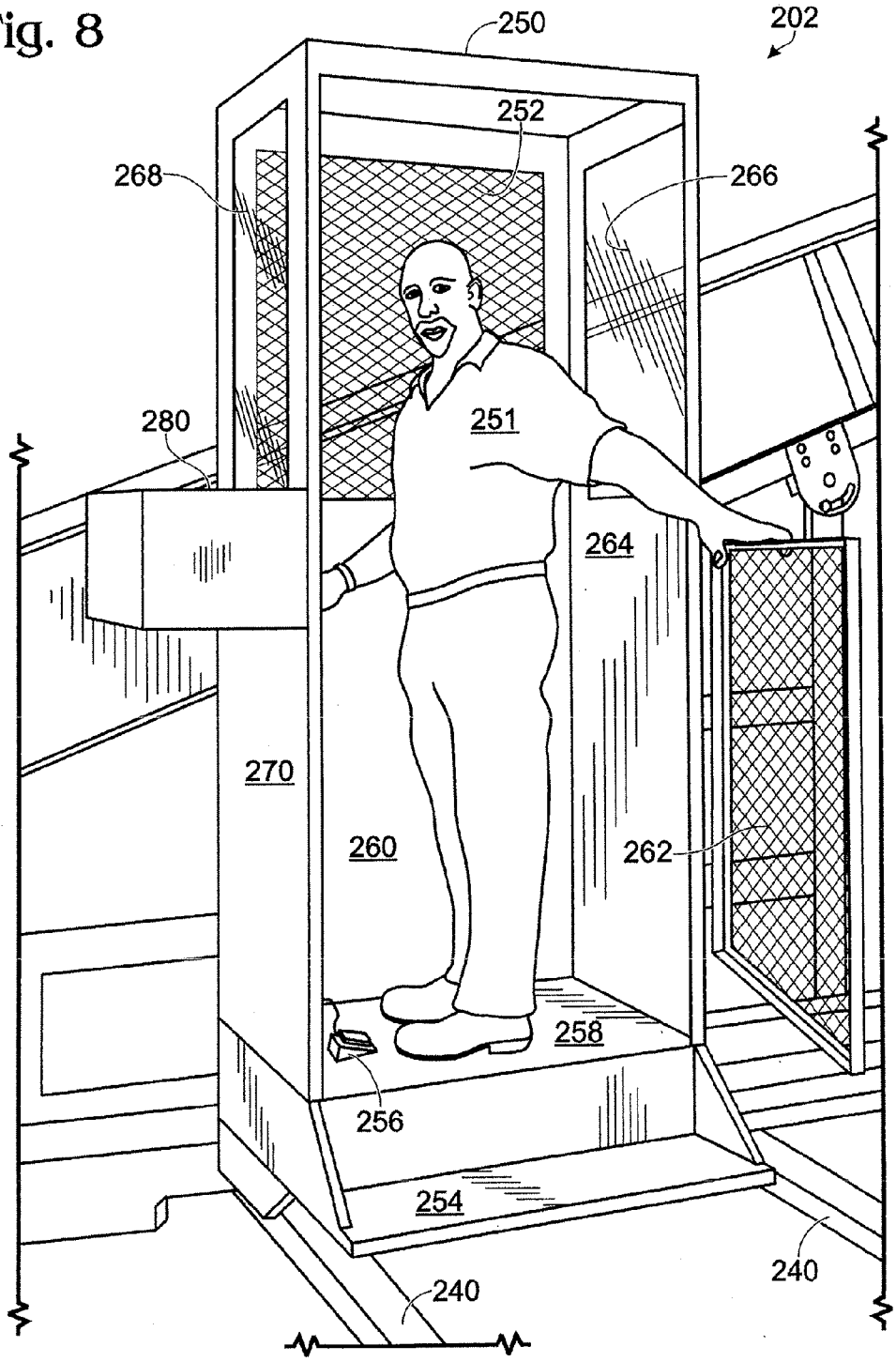
FIG. 8 is a detail view of the operator platform of the second embodiment shuttle.

FIGS. 3 to 9 show conveyor shuttle 200 for use on rails 240. Shuttle 200 includes: operator platform system 202; base frame 203; conveyor belt system frame 205; electrical power supply framework 204; conveyor belt 206; conveyor belt guide walls 208; chute system base frame 210; chute system securing hardware 212; chute member 214; first chute support member pair 216; second chute support member pair 218; third chute support member 220; fourth chute support member pair 222; fifth chute support member 224; travel motor support member 226; rail interface system 228; chute telescoping motor 230; power and control system 242; and operator control system 236, 238 (the operator control system is alternatively denominated by reference numerals 256, 280 in FIGS. 8 and 9). As shown in FIG. 8, operator platform system 202 (for use by human operator 251) includes: ceiling member 250; first wall member 268, 270 (including first window portion 268 and first solid portion 270); second wall member 252, 260 (including second window portion 252 and second solid portion 260); third wall member 264, 266 (including third window portion 266 and third solid portion 264); hinged gate 262 (this is alternatively denominated as reference numeral 232 in FIG. 4); step member 254; footswitch 256 (this is alternatively denominated as reference numeral 238 in FIG. 4); floor member 258. As shown in FIGS. 8 and 9, the control panel portion 280 (alternatively denominated as reference numeral 236 in FIG. 4) of operator control system 256, 280 includes: emergency stop button 281; display 282; first knob 283; second knob 284; third knob 285; fourth knob 286; fifth knob 287; and sixth knob 288. Although shuttle 200 includes four electrical motors to move various shuttle components, only chute telescoping motor 230 is shown in the Figures.

As best shown in FIG. 7, shuttle 200 moves along rails 240 in the wash alley direction D1, back and forth among the washing machines and drying machines (not shown) with which it loads and unloads. When a washing machine needs to be loaded, then first, the shuttle moves along rails 240 in wash alley direction D1 in order to get to the vicinity of the washing machine which it will help to load. As shown in FIG. 7, as it is making this journey to the washing machine to be loaded, 205 conveyor belt frame is in the P1 position relative to base frame 203. In this P1 position, and as shown in FIG. 7, the washer-side-end of inner frame 205 is generally flush with the washer end of inner frame 203. To put it more simply, inner frame 205 (along with the hardware it carries like the conveyor belt and guide hardware are retracted (or telescoped) in the D4 direction toward the dryer side of the wash alley. This P1 position is used during shuttle travel so that the shuttle does not physically interfere with portion of the washing machines that stick into the wash alley on the washer side of the wash alley. In wash alley embodiments where this sort of physical interference is not a problem, the conveyor belt frame may not be built to translate in the D4 direction (which makes for a less costly, less complex shuttle).

Figure 3:
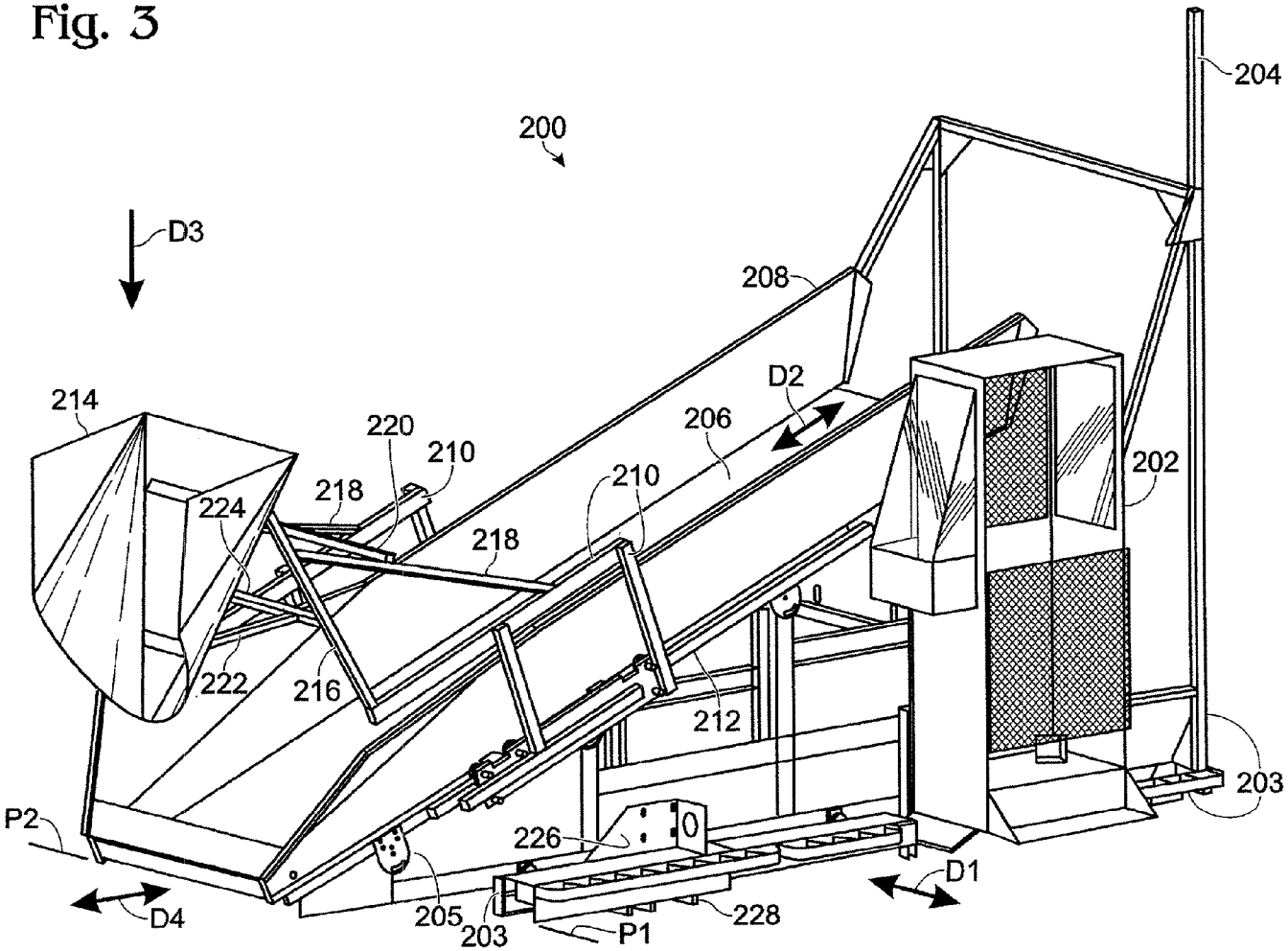
FIG. 3 is a perspective view of a second embodiment of a conveyor shuttle according to the present invention.
Figure 4:
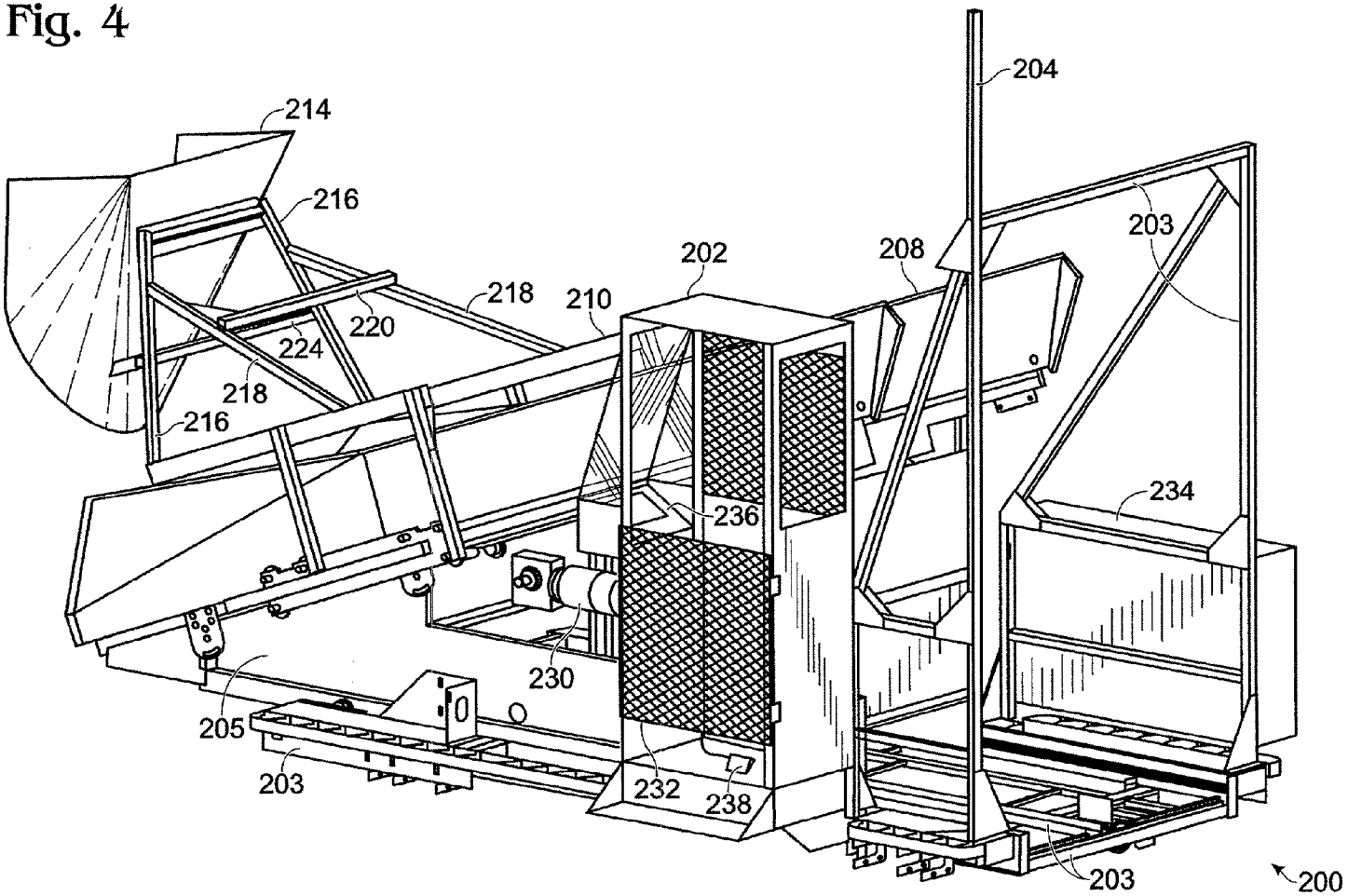
FIG. 4 is another perspective view of the second embodiment shuttle.
Figure 5:
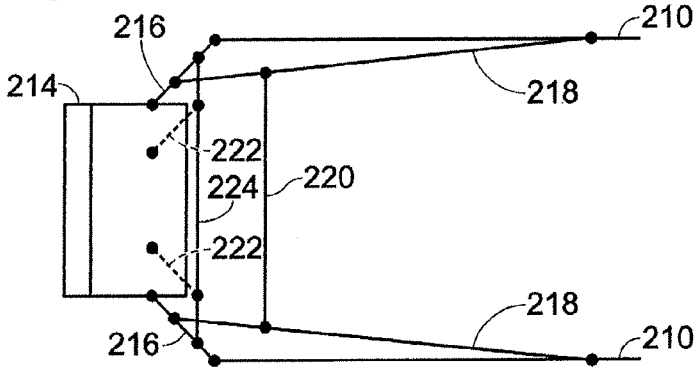
FIG. 5 is a schematic top view of the guide hardware of the second embodiment shuttle.
Figure 6:
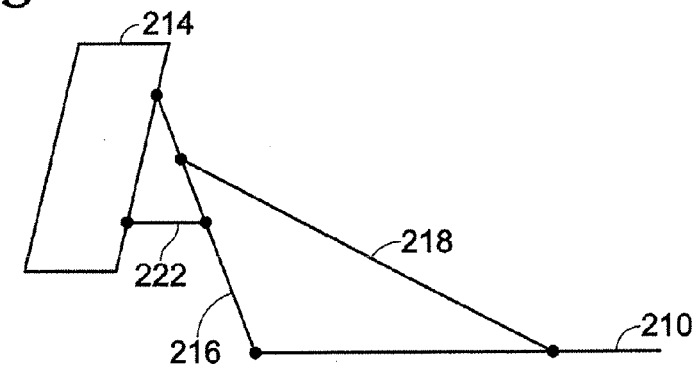
FIG. 6 is a schematic side view of the guide hardware of the second embodiment shuttle.

When shuttle 200 gets to a washing machine that it will help load, it may first receive a load of clean, but damp, laundry from the washing machine that it is about to help load. To do this, conveyor belt frame (and the hardware attached to it such as the conveyor belt and the guide hardware) are translated (or telescoped) from the P1 position to the P2 position, as best shown by comparing FIG. 3 and FIG. 7. FIG. 3 shows conveyor belt frame 205 in the P2 position, where the conveyor belt extends out from base frame 203 toward the washer-side of the wash alley. In this position, the washing machine can dump clean, but damp, laundry onto the washer-side end of conveyor belt 206. As best shown in FIG. 3, the washer-side end of conveyor belt 206 is positioned relatively low to the ground so that this portion of the conveyor belt will be below the mouth of the washer.

However, if shuttle 200 is receiving a load of laundry from the washing machine, guide hardware 214,210,216,218,220,222,224 should not be in the position in which it is shown in FIG. 3. Rather, the guide hardware should be in a position retracted (or telescoped) along the D2 direction further up conveyor belt guide walls 208. This retractability of the guide hardware is preferred in embodiments where the guide hardware could interfere with one or more of the following objects: (i) the washing machine itself when it is in the unloading position; (ii) bags of laundry suspended from a track in the ceiling; and/or (iii) workers who help load and/or unload the washing machines. In some embodiments, the motion from the retracted position (not shown) to the non-retracted position (shown in FIG. 3) may also help to guide laundry being loaded into the washer (as will be explained below) and/or provide the motion needed to undo a fastener on a laundry bag, the contents of which are about to be loaded into the washer. However, while there are potential advantages to making the guide hardware movable relative to the conveyor belt (in the D2 direction and/or other directions), this is not necessarily a requirement of all embodiments of the present invention.

After any damp laundry that is to be loaded from the washing machine onto the shuttle is so loaded, guide hardware 214,210,216,218,220,222,224 moves in the D2 direction from the retracted position (not shown) to the non-retracted position (shown in FIG. 3) to prepare for loading of the laundry. Before the loading of the laundry is described, some explanations will be made concerning possibilities relating to motion of the guide hardware. Note that in embodiment 200: (i) the guide hardware is moveably attached to conveyor belt 206 and/or its side walls 208; and (ii) the motion of the guide hardware between its retracted and non-retracted position is in the D2 direction, which is a direction generally transverse to the D1 direction. While both of these things, (i) and (ii), are preferred, neither of them is necessarily required in all embodiments of the present invention, and many variations are possible. As mentioned above, one variation is the guide hardware does not move relative to base frame 203 and/or conveyor belt frame 205. This would be preferred where: (i) there are not potential physical interference issues; (ii) the guide hardware is not required to impart a significant horizontal component to the motion of the laundry that it is helping to load into the washer; and (iii) motion of the guide hardware is not needed to unfasten the laundry bag in order to allow the soiled laundry to spill out of it.

However, even in embodiments where the guide hardware does move, it may move in directions other than D2. For example, in embodiments where the guide hardware is directly mechanically connected to the base frame rather than the conveyor belt sub-assembly 205,206,208, the guide hardware may translate in the D4 direction rather than the D2 direction (see FIG. 3). Or the guide hardware may move in a non-linear path, designed to avoid physical interferences and/or to impart the desired motion to the soiled laundry as it is loaded into the dryer. These linear or non-linear paths may be generally transverse to the D1 direction (as directions D2 and D4 are), but these motions could also be in other directions, such as motion generally along the D1 direction (that is, the wash alley direction). For example, if the guide hardware is used to help align a bag of soiled laundry, suspended from a track in the ceiling, with the mouth of the washer in the wash alley direction, then it might be preferred to build the guide hardware to be moveable in the wash alley direction. The motion of the guide hardware may be rotational only, or some combination of rotational and translational motion. Generally speaking, the motion and/or complexity of motion of the guide hardware will depend upon what functions it needs to accomplish by physical interference with other objects and what physical interferences it needs to avoid given the geometry of the wash alley and the industrial machines located therein.

In the embodiment of shuttle 200, all of the guide hardware 214,210,216,218,220,222,224 moves as a single piece, or, if you will, as a single rigid assembly. This is also not necessarily true for all embodiments of the present invention. For example, the chute 214 may be outfitted with a pusher that moves back and forth along the interior space of the chute and pushes laundry down the chute. As another variation, chute 214 could be formed from multiple panels that move in different directions to come together to form chute 214, or something like it. As a further example, portions of the guide hardware could move independently to unfasten fasteners on laundry bags or to remove laundry bags as and/or after they are emptied.

In shuttle 200, the conveyor belt telescopes first, and then the guide hardware moves. This is not necessarily the preferred order, even in embodiments that unload damp laundry onto the conveyor belt immediately before using the guide hardware to load the washer with a new load of soiled laundry. It may actually be preferably to move the guide hardware to its engagement-with-the-washer position first, and only then telescope the conveyor belt out to engage with the washer. Or, both of these telescoping motions could be preformed at the same time.

Now some various possibilities for the motion of the guide hardware have been discussed, discussion will move to the role of chute 214 in helping to load soiled laundry into the mouth (not shown) of the washing machine (not shown). At least in some embodiments the washing machine will need to move from an unloading position to a loading position. After the washing machine is in correcting loading position, the guide hardware is moved in the D2 direction, down the sides of conveyor belt walls 208, to its non-retracted position (see FIG. 3).

Once chute 214 is in its non-retracted position, the bottom of a bag of soiled laundry is unfastened at its bottom to allow the laundry to fall from the bag under the force of gravity, in the downwards direction (see FIG. 3 at direction D3). This release of the fastener at the bottom of the laundry bag could be accomplished manually or automatically (that is, by machinery). If it is done by machinery, that machinery could be part of the guide hardware, or it could be completely separate from the shuttle. The soiled laundry falls down onto the chute and is guided into the mouth of the washer by the side arms and bottom section of the generally U-shaped chute. Not only does the chute help guide laundry as it falls, but it also helps guide laundry in cases where the rotation of the washing machine tends to force articles back upwards and out of the washing machine. The chute could have other geometries, such as a tube, or O-shape, depending on how much guidance is needed, and also upon the orientation of the mouth of the washer that is being fed.

After the laundry is fed into the washer: (i) the conveyor belt conveys back to its travel (or non-retracted) position towards the dryer side of the wash alley; (ii) the guide hardware is moved back in the D2 direction towards the central portion of the conveyor belt. The shuttle then moves along the wash alley to an available dryer so that it can deposit the load of damp laundry that the washing machine has dumped onto conveyor belt 206. As will be seem in FIGS. 3, 4 and 7, the conveyor belt is inclined upwards towards its dryer-side end. This is so that the laundry will fall off of the conveyor belt, and into the mouth of the dryer, by the force of gravity. In other embodiments of the present invention, the conveyor belt may not be inclined, or the amount of incline might be made to be adjustable (for example, to allow delivery of articles to industrial machines having mouths at different heights off of the ground). Although only two positions of the telescoping conveyor belt assembly have been mentioned (that is, retracted and travel), the conveyor belt assembly may telescope to one or more additional positions to help selectively engage the industrial machines on the dryer-side of the work alley (if the dryers cannot be engaged from the travel position).

The operator platform and the operator controls, best shown in FIGS. 8 and 9, will now be discussed. The operator platform assembly 202 of shuttle 200 is enclosed on three peripheral sides by walls 270,264,260 and on the fourth side by a hinged gate 262. This helps to prevent human operator 251 from falling of the platform as the shuttle moves along the wash alley and the operator is focusing on operating the shuttle and/or the industrial machines. Step 254 allows the operator to climb up onto the platform which is elevated off of the wash alley floor. This allows operator 251 to see over conveyor belt side walls 208. These peripheral walls 260,262, 270 and the ceiling panel 250 also prevent the operator from being hit by stray wash water and/or stray articles of laundry. Alternatively, the shuttle could have more or fewer peripheral walls (for example, a cylindrical shaped platform assembly with one peripheral wall). The operator platform assembly could also be made to be more enclosed than assembly 202. For example, hinged gate 262 could be replaced by a solid door (lockable or unlockable). The operator platform assembly could also be made to be less enclosed than assembly 202. For example, the peripheral walls and ceiling could be omitted altogether. Peripheral walls 270,264,260 include windows 268,266,252. These windows may be filled with screens, mesh, solid, transparent material or nothing at all. These windows may be omitted, although some means should be provided so that the operator can see what she needs to see in order to operate the shuttle.

Operator control panel 280 (see FIG. 9) and footswitch 256 (see FIG. 8) are a user interface that allow the operator to control various aspects of operation of the shuttle and/or the wash alley. Generally speaking, this operator control could be direct or indirect. For example indirect control might include assigning bags of soiled laundry to washing machines and assigning loads of damp laundry to dryers, and then allowing computer programs to effect direct control by commanding direct actions such as: moving the shuttle along the wash alley, telescoping the conveyor belt assembly in and out of engagement with the various washers and dryers that it loads/unloads, conveying damp laundry along the conveyor belt from the wash-side to the dry-side, any independent motion of any guide hardware that may be on the shuttle, starting washing machines up for a wash cycle, unloading washing machines, starting drying machines up for a dry cycle, etc.

On the other hand, in shuttle 200, the operator control is direct and the shuttle operator directly controls: (i) the motion of the shuttle back and forth along the wash alley (although shuttle speed is automatically controlled); (ii) the unfastening of bags of soiled laundry suspended from a track in the ceiling; (iii) starting of washer and dryer cycles; (iv) telescoping motion of the conveyor belt assembly in a direction transverse to the wash ally; (v) the endless track motion (that is conveying motion) of the conveyor belt to move damp laundry in a direction generally transverse to the wash alley; and (vi) the motion of the guide hardware assembly back and forth along the conveyor belt side walls. In still other embodiments, operator control could be partially direct and partially indirect. In shuttle 200, the operator control is preferably coded in WASHNET code language.

In shuttle 200, in order to exercise operator control through control panel 280, the operator must depress footswitch 256. This effectively forces operator 251 to be in place fully on and within operator platform assembly 202. Alternatively, or additionally, other types of operator-position-assurance subsystems could be used, such as a dead hand switch, a system to detect and require that hinged gate 262 be fully shut, a floor mat that detects and requires the weight of the operator, optical detection systems, etc.

As mentioned above, operator control system 256,280 of shuttle 200 controls only operations on the shuttle. However, in embodiments where the shuttle operator 251 controls functions occurring off the shuttle, then commands would need to be communicated from the shuttle to the appropriate external components. This could be done wireless or in a wired fashion. Fore example, in embodiments where operator 251 controls the locking and unlocking of a security gate that controls human access to the wash alley, these operator commands could be communicated from the shuttle to the gate by a wired data communication path or a wireless data communication path.

A non-exclusive list on possible variations on the present invention follows:

(i) the shuttle can be inclined or have a scissor design;

(ii) the guide hardware could help guide articles of clothing into the dryer instead of, or in addition to the washer;

(iii) there could be two sets of guide hardware on the shuttle, one for each side of the work alley;

(iv) the chute may be a chute that was previous installed on a washing machine, but removed therefrom and installed on the shuttle;

(v) the operator, who is normally on the shuttle platform, may leave the shuttle to unfasten the laundry bags in some embodiments;

(vi) the guide hardware may be moveable so that it moves substantially over the entire mouth of the washing machine after the soiled laundry is first loaded—this prevents the spinning of the washing machine from causing soiled laundry to be ejected from the mouth of the washing machine before the soiled laundry has been wetted by the washing machine;

(vii) the operator platform preferably includes a handle for the operator to hand onto for balance (the operator is shown holding on to such a handle (no separate reference number) in FIG. 8;

(viii) the operator platform could be at other locations on the shuttle frame;

(ix) there could be one operator platform on each side of the conveyor belt;

(x) the control panel could be positioned so that the operator is facing a different direction than in shuttle 200; and (xi) other controls may be used on the control panel, such as touchscreen(s), joystick(s); steering wheel (for embodiments not on rails); a keyboard and so on.

Definitions

Any and all published documents mentioned herein shall be considered to be incorporated by reference, in their respective entireties, herein to the fullest extent of the patent law. The following definitions are provided for claim construction purposes:

Present invention: means at least some embodiments of the present invention; references to various feature(s) of the "present invention" throughout this document do not mean that all claimed embodiments or methods include the referenced feature(s).

Embodiment: a machine, manufacture, system, method, process and/or composition that may (not must) meet the embodiment of a present, past or future patent claim based on this patent document; for example, an "embodiment" might not be covered by any claims filed with this patent document, but described as an "embodiment" to show the scope of the invention and indicate that it might (or might not) covered in a later arising claim (for example, an amended claim, a continuation application claim, a divisional application claim, a reissue application claim, a re-examination proceeding claim, an interference count); also, an embodiment that is indeed covered by claims filed with this patent document might cease to be covered by claim amendments made during prosecution.

First, second, third, etc. ("ordinals"): Unless otherwise noted, ordinals only serve to distinguish or identify (e.g., various members of a group); the mere use of ordinals shall not be taken to necessarily imply order (for example, time order, space order).

Electrically Connected: means either directly electrically connected, or indirectly electrically connected, such that intervening elements are present; in an indirect electrical connection, the intervening elements may include inductors and/or transformers.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, quick-release connections, latches and/or magnetic connections), force fit connections, friction fit connections, connections secured by engagement caused by gravitational forces, pivoting or rotatable connections, and/or slidable mechanical connections.

Data communication: any sort of data communication scheme now known or to be developed in the future, including wireless communication, wired communication and communication routes that have wireless and wired portions; data communication is not necessarily limited to: (i) direct data communication; (ii) indirect data communication; and/or (iii) data communication where the format, packetization status, medium, encryption status and/or protocol remains constant over the entire course of the data communication.

Receive/provide/send/input/output: unless otherwise explicitly specified, these words should not be taken to imply: (i) any particular degree of directness with respect to the relationship between their objects and subjects; and/or (ii) absence of intermediate components, actions and/or things interposed between their objects and subjects.

Wall: may be solid, mesh, opaque, transparent, have openings, or any combination of the foregoing features; walls are not required to be planar, or free of discontinuities, by they are generally flat.

Guide hardware: any hardware that can guide any type of article as it travels, and is not limited to chutes that are suitable for guiding textiles as the fall under the force of gravity.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control.

Unless otherwise explicitly provided in the claim language, steps in method steps or process claims need only be performed in the same time order as the order the steps are recited in the claim only to the extent that impossibility or extreme feasibility problems dictate that the recited step order be used. This broad interpretation with respect to step order is to be used regardless of whether the alternative time ordering(s) of the claimed steps is particularly mentioned or discussed in this document—in other words, any step order discussed in the above specification shall be considered as required by a method claim only if the step order is explicitly set forth in the words of the method claim itself. Also, if some time ordering is explicitly set forth in a method claim, the time ordering claim language shall not be taken as an implicit limitation on whether claimed steps are immediately consecutive in time, or as an implicit limitation against intervening steps.

What is claimed is:

1. A conveyor shuttle for use in a work alley defining a work alley direction having a plurality of first type industrial machines on a first side of the work alley and a plurality of second type industrial machines on a second side of the work alley, the shuttle comprising:

a shuttle driving system;

a chassis;

a conveyor belt system comprising a conveyor belt that is structured, connected and/or located to: (i) allow loading of articles from the first type machines; (ii) allow unloading of articles into the second type machines; and (iii) convey articles, in a conveyor belt direction that is generally transverse to the work alley direction, from the first side to the second side;

a first conveyor belt guide wall and a second conveyor belt guide wall, each of which (i) is mechanically connected to a different side of the conveyor belt, (ii) has a length in a lengthwise direction parallel to the conveyor belt direction, and (iii) has a width in a widthwise direction perpendicular to the conveyor belt direction; and a guide hardware system comprising a chute member and a chute member supporting system, the chute member supporting system including a base member structured, located and/or mechanically connected to the first and second conveyor belt guide walls and translatable in at least two directions, wherein a first direction is generally transverse to a travel direction of the conveyor shuttle in the work alley, and a second direction that can be generally transverse to the travel direction of the conveyor shuttle in the work alley or generally parallel along the travel direction of the conveyor shuttle in the work alley;

wherein:

the shuttle drive system, the conveyor belt system and the guide hardware are mechanically connected (directly or indirectly) to the chassis; the shuttle drive system is structured, located and/or connected to drive the shuttle into motion so that it can travel along the work alley among and between the first type machines and the second type machines; and the guide hardware system is structured, connected and/or located to guide articles as they travel from location generally above each first side machine and into an opening in each first side machine.

2. The shuttle of claim 1 wherein:

the work alley is a wash alley;

the first type machines are industrial washing machines;

the second type machines are industrial drying machines;

the articles are textiles that are being washed and dried; and the guide hardware system is further structured, connected and/or located to soiled textile articles as they travel from location generally above each industrial washing machine and into a mouth of each washing machine.

3. The shuttle of claim 2 wherein the chute member supporting system is further structured, located and/or connected to selectively move the chute member in the conveyor belt direction between at least: (i) a first position where it is positioned sufficiently close to the mouth of a washing machine that is being loaded with the assistance of the guide hardware; and (ii) a second position where the chute member is sufficiently distant from the washing machines on the first side of the wash alley.

4. A conveyor shuttle for use in a work alley defining a work alley direction having a plurality of first type industrial machines on a first side of the work alley and a plurality of second type industrial machines on a second side of the work ally, the shuttle comprising:

a shuttle driving system;

a chassis;

a conveyor belt system comprising a conveyor belt that is structured, connected and/or located to: (i) allow loading of articles from the first type machines; (ii) allow unloading of articles into the second type machines; and (iii) convey articles, in a conveyor belt direction that is generally transverse to the work alley direction, from the first side to the second side;

a first conveyor belt guide wall and a second conveyor belt guide wall, each of which (i) is mechanically connected to a different side of the conveyor belt, (ii) has a length in a lengthwise direction parallel to the conveyor belt direction, and (iii) has a width in a widthwise direction perpendicular to the conveyor belt direction;

a guide hardware system comprising a chute member and a chute member supporting system, the chute member supporting system including a base member structured, located and/or mechanically connected to mechanically connect the chute member to the first and second conveyor belt guide walls at a location above at least a portion of the conveyor belt and translatable in at least two directions, wherein a first direction is generally transverse to a travel direction of the conveyor shuttle in the work alley, and a second direction that can be generally transverse to the travel direction of the conveyor shuttle in the work alley or generally parallel along the travel direction of the conveyor shuttle in the work alley;

an operator platform system; and an operator control system;

wherein:

the shuttle drive system, the conveyor belt system, the operator control system and the operator platform system are mechanically connected (directly or indirectly) to the chassis;

the shuttle drive system is structured, located and/or connected to drive the shuttle into motion so that it can travel along the work alley among and between the first type machines and the second type machines;

the guide hardware system is structured, connected and/or located to guide articles as they travel from location generally above each first side machine and into an opening in each first side machine;

the operator platform system is sized, shaped, structured and located to accommodate a user riding on the shuttle; and the operator control system is structured, located and or connected to allow the human user to at least partially control at least one of the following functions: travel of the shuttle along the work alley direction, operation of the first side machines, operation of the second side machines, operation of the conveyor belt system, operation of any security system protecting the work alley and/or movement of any guide hardware.

5. The shuttle of claim 4 wherein:

the work alley is a wash alley;

the first type machines are industrial washing machines;

the second type machines are industrial drying machines;

the articles are textiles that are being washed and dried; and the operator control system is structured, located and or connected to allow the human user to at least partially control at least one of the following functions: travel of the shuttle along the wash alley, washing operation of the washing machines, loading operation of the washing machines, unloading operation of the washing machines, drying operation of the drying machines, loading operation of the drying machines, operation of the conveyor belt system for conveying textiles from a washing machine to a drying machine, operation of any security system protecting the work alley and/or movement of any guide hardware for helping to load the textile articles into a washing machine.

6. The shuttle of claim 5 wherein the operator platform system comprises:

a floor portion sized, shaped and/or located to support the human user; and at least one wall to at least partially enclose a human user in the operator platform system.

7. The shuttle of claim 6 wherein the operator control system comprises a user interface that comprises a control panel and at least one footswitch.

8. A conveyor shuttle for use in a wash alley defining a wash alley direction having a plurality of industrial washing machines on a washing side of the wash alley and a plurality of industrial drying machines on a drying side of the wash ally, the shuttle comprising:

a shuttle driving system;

a chassis;

a conveyor belt system comprising a conveyor belt that is structured, connected and/or located to: (i) allow loading of damp textile articles from the washing machines; (ii) allow unloading of damp textile articles into the second type machines; and (iii) convey articles, in a conveyor belt direction that is generally transverse to the work alley direction, from the washing side to the drying side;

a first conveyor belt guide wall and a second conveyor belt guide wall, each of which (i) is mechanically connected to a different side of the conveyor belt, (ii) has a length in a lengthwise direction parallel to the conveyor belt direction, and (iii) has a width in a widthwise direction perpendicular to the conveyor belt direction;

a guide hardware system comprising a chute member and a chute member supporting system, the chute member supporting system including a base member structured, located and/or mechanically connected to mechanically connect the chute member to the first and second conveyor belt guide walls at a location above at least a portion of the conveyor belt and translatable in at least two directions, wherein a first direction is generally transverse to a travel direction of the conveyor shuttle in the work alley, and a second direction that can be generally transverse to the travel direction of the conveyor shuttle in the work alley or generally parallel along the travel direction of the conveyor shuttle in the work alley;

an operator platform system; and an operator control system;

wherein:

the shuttle drive system, the conveyor belt system and the guide hardware are mechanically connected (directly or indirectly) to the chassis;

the shuttle drive system is structured, located and/or connected to drive the shuttle into motion so that it can travel along the wash alley among and between the washing machines and the drying machines;

the guide hardware system is structured, connected and/or located to guide articles as they travel from location generally above each first side machine and into an opening in each first side machine;

the operator platform system is sized, shaped, structured and located to accommodate a user riding on the shuttle; and the operator control system is structured, located and or connected to allow the human user to at least partially control at least one of the following functions: travel of the shuttle along the work alley direction, operation of the first side machines, operation of the second side machines, operation of the conveyor belt system, operation of any security system protecting the work alley and/or movement of any guide hardware.

* * * * *